US011586124B2

(12) United States Patent
Park

(10) Patent No.: US 11,586,124 B2
(45) Date of Patent: Feb. 21, 2023

(54) TONER SUPPLY BY CHANGING DRIVING SPEED OF DEVELOPING APPARATUS

(71) Applicant: Hewlett-Packard Development Company, L.P., Spring, TX (US)

(72) Inventor: Youngjin Park, Seongnam-si (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/272,722

(22) PCT Filed: Dec. 2, 2019

(86) PCT No.: PCT/US2019/063957
§ 371 (c)(1),
(2) Date: Mar. 2, 2021

(87) PCT Pub. No.: WO2020/251617
PCT Pub. Date: Dec. 17, 2020

(65) Prior Publication Data

US 2021/0373457 A1 Dec. 2, 2021

(30) Foreign Application Priority Data

Jun. 14, 2019 (KR) ..... 10-2019-0070995

(51) Int. Cl.
*G03G 15/08* (2006.01)
*G03G 15/00* (2006.01)

(52) U.S. Cl.
CPC ..... *G03G 15/0849* (2013.01); *G03G 15/0877* (2013.01); *G03G 15/55* (2013.01);
(Continued)

(58) Field of Classification Search
CPC ..... G03G 15/0849; G03G 15/0877; G03G 15/55; G03G 15/0893; G03G 2215/0888; G03G 15/556; G03G 15/5008
See application file for complete search history.

(56) References Cited

U.S. PATENT DOCUMENTS 5,005,517 A * 4/1991 Fukui ..... G03G 15/0126 118/689
5,974,280 A * 10/1999 Takesue ..... G03G 15/043 399/43

(Continued)

FOREIGN PATENT DOCUMENTS

CN 101256380 A 9/2008
EP 0 540 057 A2 5/1993

(Continued)

*Primary Examiner* — Arlene Heredia
*Assistant Examiner* — Laura Roth
(74) *Attorney, Agent, or Firm* — Foley & Lardner LLP

(57) ABSTRACT

An example method of operating an image forming apparatus includes measuring a toner concentration supplied to a developing apparatus and increasing a driving speed of the developing apparatus based on the toner concentration not reaching a target toner concentration. The toner concentration is measured in a state where the driving speed of the developing apparatus is increased, and, based on the toner concentration not reaching the target toner concentration based on the driving speed of the developing apparatus being increased, an operating state of the image forming apparatus is determined based on a remaining amount of toner.

20 Claims, 11 Drawing Sheets

(52) U.S. Cl.
CPC ..... *G03G 15/5008* (2013.01); *G03G 15/556* (2013.01); *G03G 2215/0888* (2013.01)

(56) References Cited

U.S. PATENT DOCUMENTS

| | | | | |
|---|---|---|---|---|
| 8,099,002 | B2 * | 1/2012 | Izumi | G03G 15/0844 399/30 |
| 8,755,702 | B2 * | 6/2014 | Takeda | G03G 15/0849 399/62 |
| 9,360,795 | B2 | 6/2016 | Kang et al. | |
| 2007/0003296 | A1 * | 1/2007 | Miyata | G03G 15/0856 399/27 |
| 2009/0317105 | A1 * | 12/2009 | Tsutsumi | G03G 15/0853 399/53 |
| 2011/0064435 | A1 * | 3/2011 | Takahashi | G03G 15/0877 399/58 |
| 2011/0182605 | A1 * | 7/2011 | Otsuka | G03G 15/0877 399/55 |
| 2021/0055680 | A1 * | 2/2021 | Kunihisa | G03G 15/0887 |

FOREIGN PATENT DOCUMENTS

| | | | |
|---|---|---|---|
| EP | 1 788 457 | A2 | 5/2007 |
| JP | 11-2951 | A | 1/1999 |
| JP | 2005-308913 | A | 11/2005 |
| JP | 2009-244439 | A | 10/2009 |
| JP | 2010-91785 | A | 4/2010 |
| WO | WO-2019/054522 | A1 | 3/2019 |

* cited by examiner

TONER SUPPLY BY CHANGING DRIVING SPEED OF DEVELOPING APPARATUS

BACKGROUND

An image forming apparatus using an electrophotographic method supplies toner to an electrostatic latent image formed on a photoconductor to form a visible toner image on the photoconductor, transfers the toner image to a printing medium via an intermediate transfer medium or directly to a printing medium, and fixes the transferred toner image on the printing medium.

BRIEF DESCRIPTION OF THE DRAWINGS

Various examples will be described below in conjunction with the accompanying drawings, in which.

DETAILED DESCRIPTION OF EXAMPLES

In the following description, an "image forming apparatus" may refer to any device capable of performing an image forming job, such as a printer, a copier, a scanner, a fax machine, a multi-function printer (MFP), or a display device. The "image forming job" may be at least one of printing, copying, scanning, or faxing.

Below, a description will be given of examples of the present disclosure with reference to the attached drawings such that those of ordinary skill in the art may easily perform examples. In this regard, the present disclosure may have different forms and should not be construed as being limited to the descriptions set forth herein.

Figure 1:
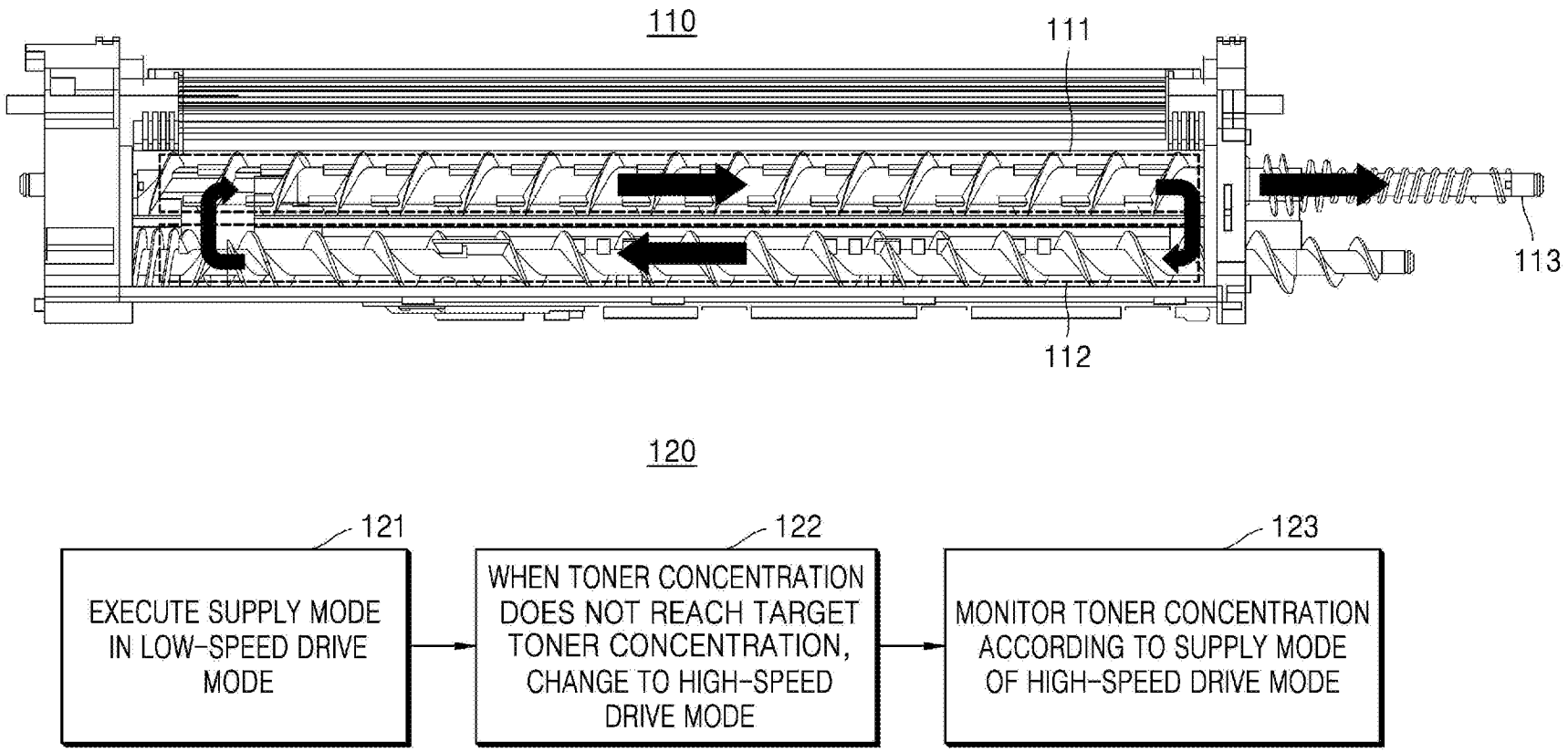
FIG. 1 is a diagram for describing an operation of controlling a driving speed of a developing apparatus operating in a supply mode in an image forming apparatus, according to an example.

FIG. 1 is a diagram for describing an operation of controlling a driving speed of a developing apparatus operating in a supply mode in an image forming apparatus, according to an example.

Referring to FIG. 1, an internal view of a developing apparatus of an image forming apparatus is illustrated in diagram 110. The developing apparatus shown in FIG. 1 may correspond to a developing apparatus 1110 of an image forming apparatus 10 shown in FIG. 11. The developing apparatus 1110 may be supplied with a developer. The developer may include toner and a carrier. The developer in the developing apparatus 1110 may be circulated clockwise as an auger rotates, as shown by the arrows in the diagram 110 of FIG. 1. As the developing apparatus 1110 is driven, the developing apparatus 1110 may discharge a certain amount of the developer through a discharge port 113. The image forming apparatus 10 may control driving of the developing apparatus 1110 so that the developer in the developing apparatus 1110 may be maintained at a desired amount by auto developer replenishment (ADR). The image forming apparatus 10 may control the driving of the developing apparatus 1110 so that a toner concentration (i.e., the ratio of toner to the developer) satisfies a certain range.

Referring to the diagram 110 of FIG. 1, when the developing apparatus 1110 is operated in a low-speed drive mode and a circulation direction of the developer is vertical, more developer may be distributed in a second region 112, which is a region lower than a first region 111 in the developing apparatus, by the influence of gravity. If more developer is distributed in the second region 112 than in the first region 111, congestion may occur in circulation of the developer. As the driving speed is reduced, the congestion of the developer may be increased. When congestion occurs in the circulation of the developer, the developer is concentrated in the second region 112. In that case, a toner concentration value sensed by a toner concentration (TC) sensor in the developing apparatus 1110 may be inaccurate.

Further, when the supply mode of toner is executed in the low-speed drive mode of the developing apparatus 1110, the volume of developer is increased because the toner is supplied to the developing apparatus 1110. However, the supplied toner may not be uniformly mixed with the developer in the developing apparatus 1110. As a result, the sensing value sensed by the toner concentration sensor may be inaccurate and the toner may be excessively supplied to the developing apparatus 1110. Thus, the operation of supplying an accurate amount of toner may not be performed. Accordingly, the image forming apparatus 10 may change the low-speed drive mode of the developing apparatus 1110 to a high-speed drive mode, to more uniformly mix the supplied toner with the developer in the developing apparatus 1110 and obtain a more accurate sensing value sensed by the toner concentration sensor.

For example, referring to a diagram 120 of FIG. 1, in operation 121, the image forming apparatus 10 may execute a supply mode for supplying toner to the developing apparatus 1110 in the low-speed drive mode. For example, the low-speed drive mode may be executed when a special paper is used in the image forming apparatus 10 or when a high-quality image is output. The driving speed in the low-speed drive mode may be lower than the driving speed in the normal driving mode by a certain speed. In operation 122, when the toner concentration does not reach the target toner concentration even if a supply operation is performed a certain number of times according to the supply mode, the image forming apparatus 10 may change the low-speed driving mode of the developing apparatus 1110 to the high-speed drive mode. In operation 123, the image forming apparatus 10 may monitor the toner concentration according to the supply mode of the high-speed drive mode. When the toner concentration reaches the target toner concentration, the image forming apparatus 10 may stop the high-speed drive mode and perform the image forming job according to the low-speed drive mode. In an example, the image forming apparatus 10 may determine an operating state of the image forming apparatus 10 based on a remaining amount of toner when the toner concentration does not reach the target toner concentration even if the supply operation is performed a certain number of times. In FIGS. 2 to 11, examples of operating an image forming apparatus that performs an operation in a supply mode for supplying toner in a low-speed drive mode will be described.

Figure 2:
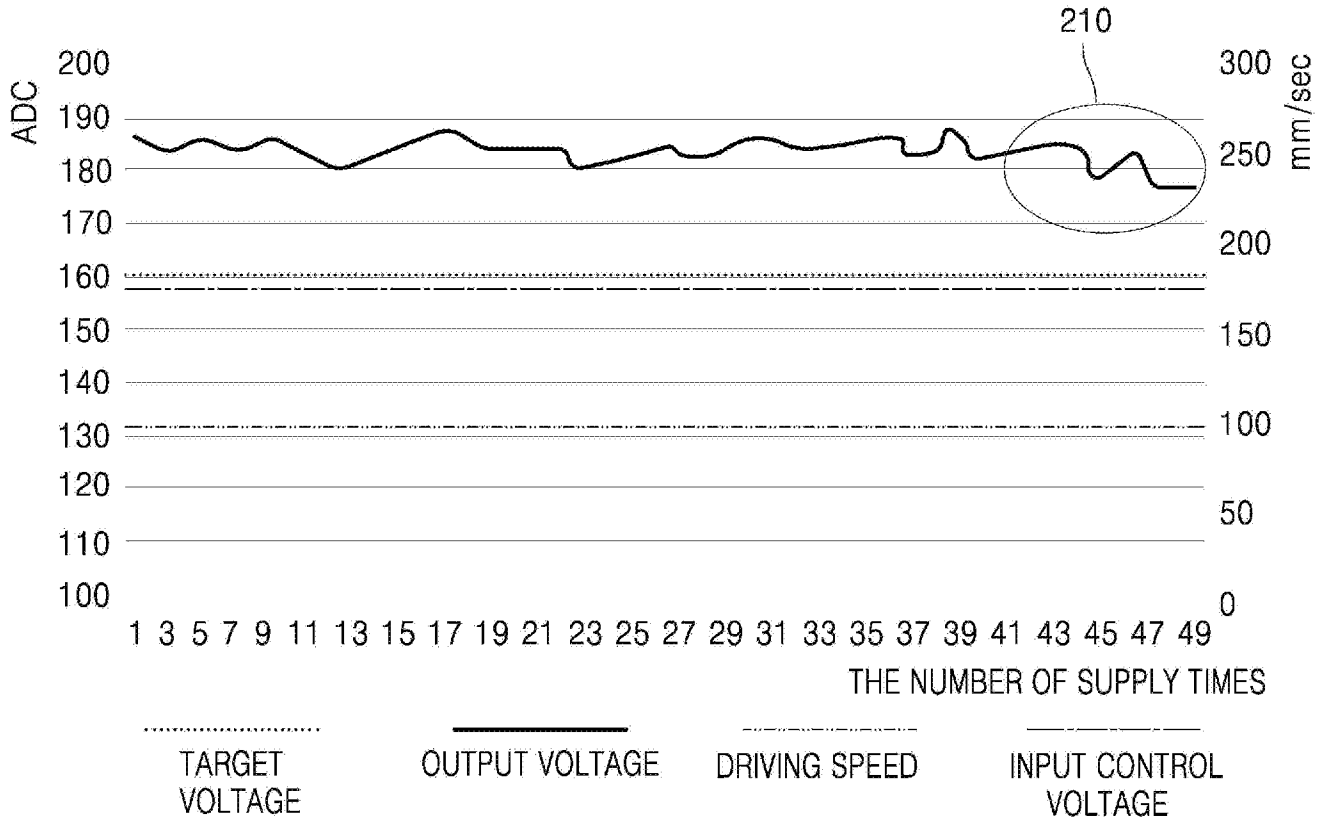
FIG. 2 is a diagram for describing an output voltage of a toner concentration sensor and a target toner concentration voltage when a developing apparatus operates in a supply mode of a low-speed drive mode, according to an example.

FIG. 2 is a diagram for describing an output voltage of a toner concentration sensor and a target toner concentration voltage when a developing apparatus operates in a supply mode of a low-speed drive mode, according to an example.

Referring to FIG. 2, the developing apparatus 1110 may supply toner in the low-speed drive mode. In an example, the driving speed may be 90 mm/sec in the low-speed drive mode. In this case, a target voltage of the toner concentration sensor may correspond to a 160 ADC value. Here, the ADC value may be a value obtained by converting an analog voltage value output from the toner concentration sensor into an 8 bit digital value. In an example, the output voltage of the toner concentration sensor may correspond to a value greater than or equal to a 170 ADC value until the number of supply operations reaches 50.

That is, although the toner supply mode is being executed in the developing apparatus 1110, since the output voltage of the toner concentration sensor of the developing apparatus 1110 in the low-speed drive mode is greater than the target voltage, the toner concentration has not reached the target toner concentration.

As an example, about 300 mg of toner may be supplied to the developing apparatus 1110 each time a supply operation is performed. Referring to a region 210 of FIG. 2, even when the supply operation is performed 50 times, the output voltage of the toner concentration sensor does not reach the target voltage. Therefore, the image forming apparatus 10 may determine that there is an error in the supply mode. For example, when toner is normally supplied to the developing apparatus 1110, but the output voltage sensed by the toner concentration sensor is not normally sensed (i.e., is less than the target voltage), the supply mode may not be normally performed. Further, when the remaining amount of toner in a toner cartridge is almost exhausted, the supply mode may not be normally performed.

In an example, the image forming apparatus 10 may accelerate the driving speed of the developing apparatus 1110 at a certain point in the supply mode in order to shorten the execution time of the supply mode and obtain a more accurate sensing value at the toner concentration sensor.

Figure 3:
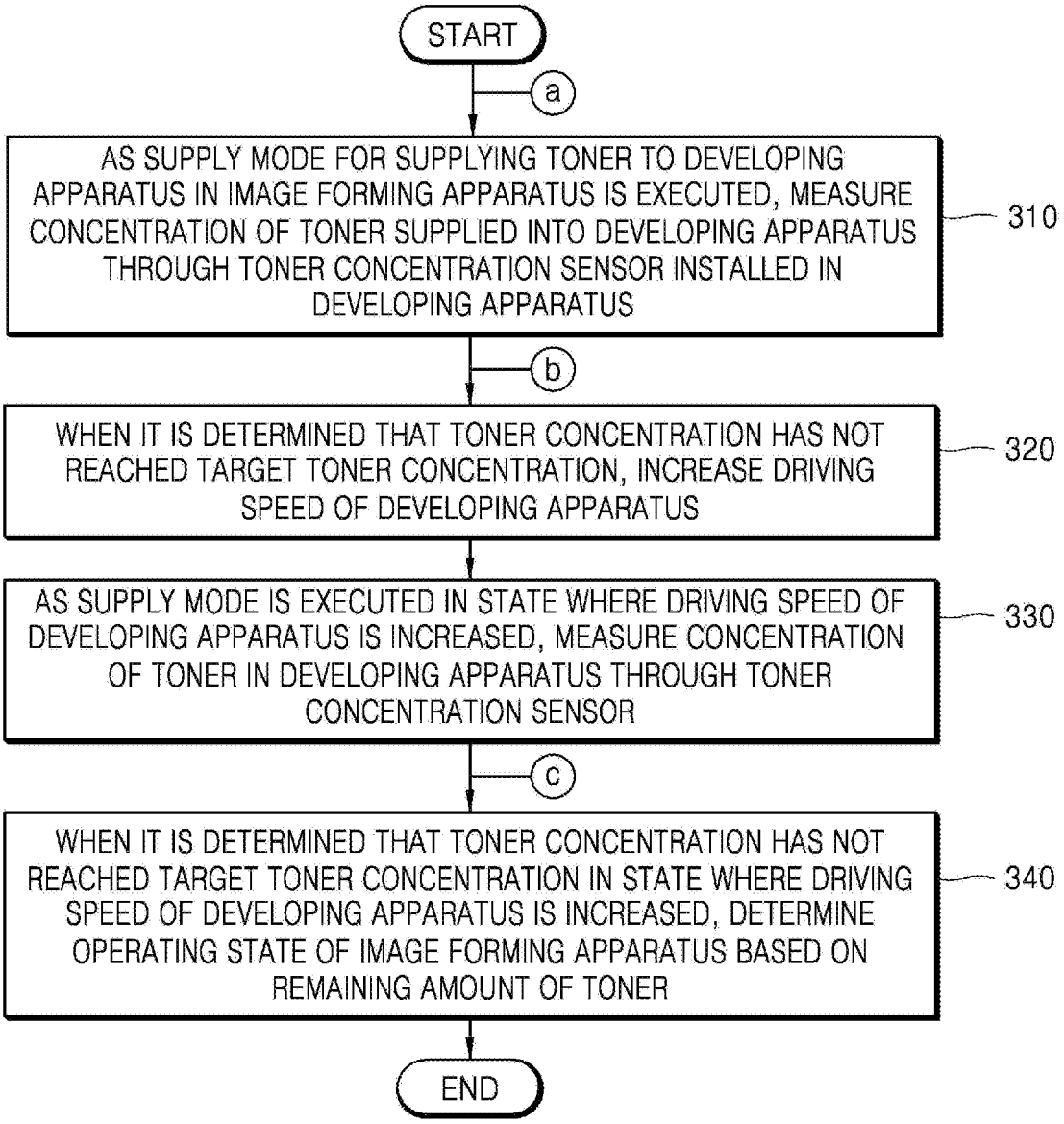
FIG. 3 is a diagram for describing a process of operating an image forming apparatus, according to an example.

FIG. 3 is a diagram for describing a process of operating an image forming apparatus, according to an example.

Referring to FIG. 3, as a supply mode for supplying toner to the developing apparatus 1110 in the image forming apparatus 10 is executed, the image forming apparatus 10 may measure a concentration of toner in the developing apparatus 1110 through a toner concentration sensor installed in the developing apparatus 1110 in operation 310.

For example, the image forming apparatus 10 may obtain a toner concentration of the developing apparatus 1110 based on a voltage value output by the toner concentration sensor. The image forming apparatus 10 may compare the toner concentration of the developing apparatus 1110 with a target toner concentration and may execute the supply mode when a difference between the toner concentration and the target toner concentration deviates from a certain range.

For example, when the supply mode is executed in a preset low-speed drive mode of the developing apparatus 1110, the image forming apparatus 10 may maintain a driving speed corresponding to the low-speed drive mode until the number of supply times reaches a first threshold value. Here, the number of supply times may correspond to the supply mode. The first threshold value may be the number of supply times corresponding to a point in time at which the driving speed of the developing apparatus 1110 is increased. The image forming apparatus 10 may increase the number of supply times by one and measure the toner concentration.

For example, the image forming apparatus 10 may calculate the amount of toner to be supplied based on the toner concentration in the developing apparatus 1110 and a target toner concentration. The image forming apparatus 10 may determine the first threshold value based on the amount of toner to be supplied and the amount of toner supplied per the number of supply times of the toner.

In operation 320, when it is determined that the toner concentration has not reached the target toner concentration, the image forming apparatus 10 may increase the driving speed of the developing apparatus 1110.

For example, when it is determined that the toner concentration has not reached the target toner concentration when the number of supply times reaches the first threshold value, the image forming apparatus 10 may increase the driving speed of the developing apparatus 1110 to a driving speed corresponding to a preset high-speed drive mode.

In an example, as the driving speed of the developing apparatus 1110 is increased to a driving speed corresponding to the preset high-speed drive mode, the image forming apparatus 10 may maintain the target toner concentration by reducing the target voltage corresponding to the target toner concentration and a control voltage input to the toner concentration sensor.

In operation 330, as the supply mode is executed in a state where the driving speed of the developing apparatus 1110 is increased, the image forming apparatus 10 may measure the concentration of the toner in the developing apparatus 1110 through the toner concentration sensor.

For example, the image forming apparatus 10 may monitor whether the toner concentration has reached the target toner concentration when the number of counted supply times according to the supply mode reaches a second threshold value indicating the maximum number of supply times, which is a reference for determining an error of the supply mode. The image forming apparatus 10 may increase the number of supply times by one and measure the toner concentration.

In operation 340, when it is determined that the toner concentration has not reached the target toner concentration in a state where the driving speed of the developing apparatus 1110 is increased, the image forming apparatus 10 may determine an operating state of the image forming apparatus 10 based on the remaining amount of toner. Here, the remaining amount of the toner may refer to an amount of toner in a toner container for containing toner in a cartridge. The toner container may supply toner to the developing apparatus 1110.

For example, when it is determined that the toner concentration has not reached the target toner concentration when the number of supply times reaches the second threshold value and the remaining amount of toner is greater than a reference value, the image forming apparatus 10 may determine that there is an operation error according to the supply mode. The image forming apparatus 10 may display a toner supply error message for the supply mode.

As another example, when it is determined that the toner concentration has not reached the target toner concentration when the number of supply times reaches the second threshold value and the remaining amount of toner is less than a reference value, the image forming apparatus 10 may determine that a toner cartridge needs to be replaced. The image forming apparatus 10 may display a message informing of the need to replace the toner cartridge.

In an example, when it is determined that the toner concentration has reached the target toner concentration as the supply mode is executed in a state where the driving speed of the developing apparatus 1110 is increased, the image forming apparatus 10 may change the driving speed in the increased state to a driving speed in an existing state. The image forming apparatus 10 may perform a certain image forming job at the driving speed in the existing state. For example, the developing apparatus 1110 may be changed from the supply mode of the low-speed drive mode to a supply mode of the high-speed drive mode. When the toner concentration reaches the target toner concentration in the supply mode of the high-speed drive mode, the image forming apparatus 10 may change the high-speed drive mode to the low-speed drive mode and perform a certain image forming job at the driving speed corresponding to the low-speed drive mode.

When the toner concentration does not reach the target toner concentration by a first supply count when the supply mode is executed in the developing apparatus 1110, the image forming apparatus 10 may increase the driving speed of the developing apparatus 1110. The image forming apparatus 10 may shorten an execution time of the supply mode and determine whether the supply mode is normally executed by executing the supply mode with the driving speed of the developing apparatus 1110 increased.

Figure 4:
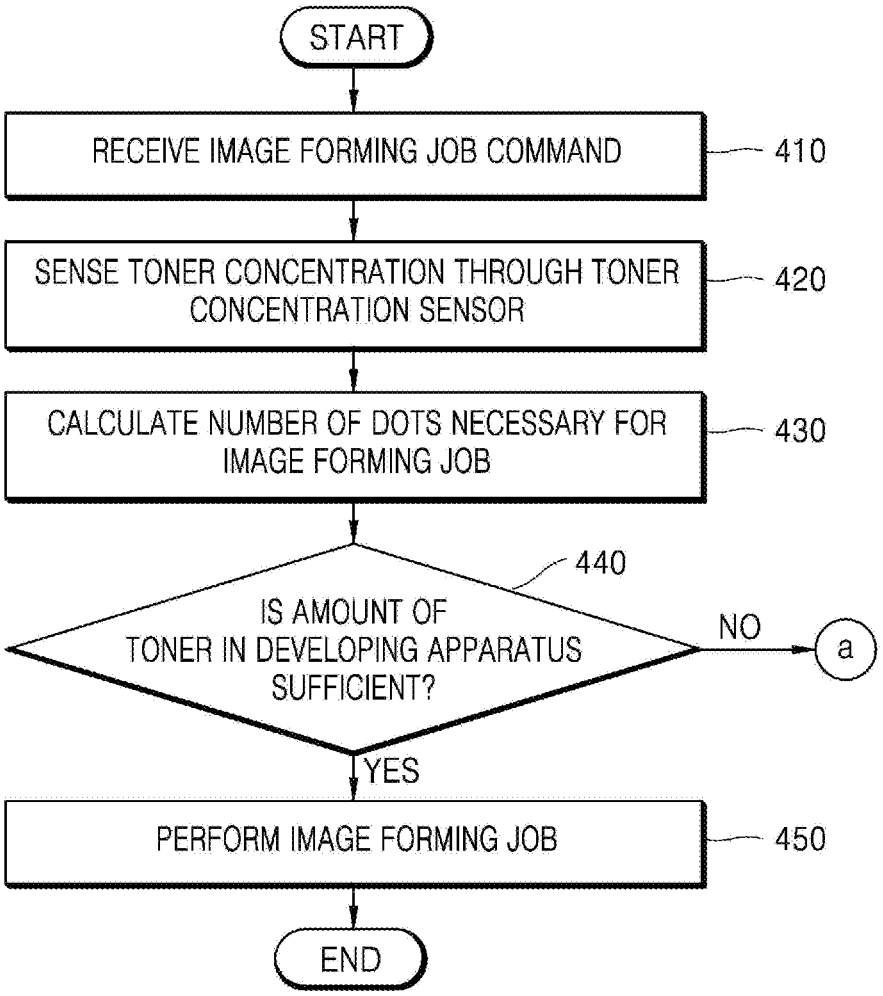
FIG. 4 is a diagram for describing a process of executing a supply mode in an image forming apparatus, according to an example.

FIG. 4 is a diagram for describing a process of executing a supply mode in an image forming apparatus, according to an example.

Referring to FIG. 4, the image forming apparatus 10 may receive an image forming job command in operation 410. For example, the image forming apparatus 10 may receive a print job command. The image forming apparatus 10 may perform a preparatory operation for an image forming job in accordance with the image forming job command.

In operation 420, the image forming apparatus 10 may sense a toner concentration through a toner concentration sensor. For example, the toner concentration sensor may measure magnetic permeability of a certain region in the developing apparatus 1110 and obtain a voltage value proportional to the amount of carrier. Therefore, the higher the voltage value measured by the toner concentration sensor, the greater the amount of carrier and the lower the ratio of toner to a developer. On the contrary, the lower the voltage value measured by the toner concentration sensor, the lower the amount of carrier and the higher the ratio of toner to the developer. The image forming apparatus 10 may calculate the toner concentration based on the voltage value measured by the toner concentration sensor.

In operation 430, the image forming apparatus 10 may calculate the number of dots necessary for the image forming job (i.e., may calculate the amount of toner necessary for the image forming job).

In operation 440, the image forming apparatus 10 may determine whether the amount of toner in the developing apparatus 1110 is sufficient based on the toner concentration and the number of dots. When the amount of toner in the developing apparatus 1110 is sufficient, the image forming apparatus 10 may perform a certain image forming job in accordance with operation 450 of the image forming apparatus 10. On the other hand, when the amount of toner in the developing apparatus 1110 is not sufficient, the image forming apparatus 10 may perform operation ⓐ of executing a supply mode of toner. An example operation ⓐ of executing the supply mode of toner in the image forming apparatus 10 is described in FIG. 5.

Figure 5:
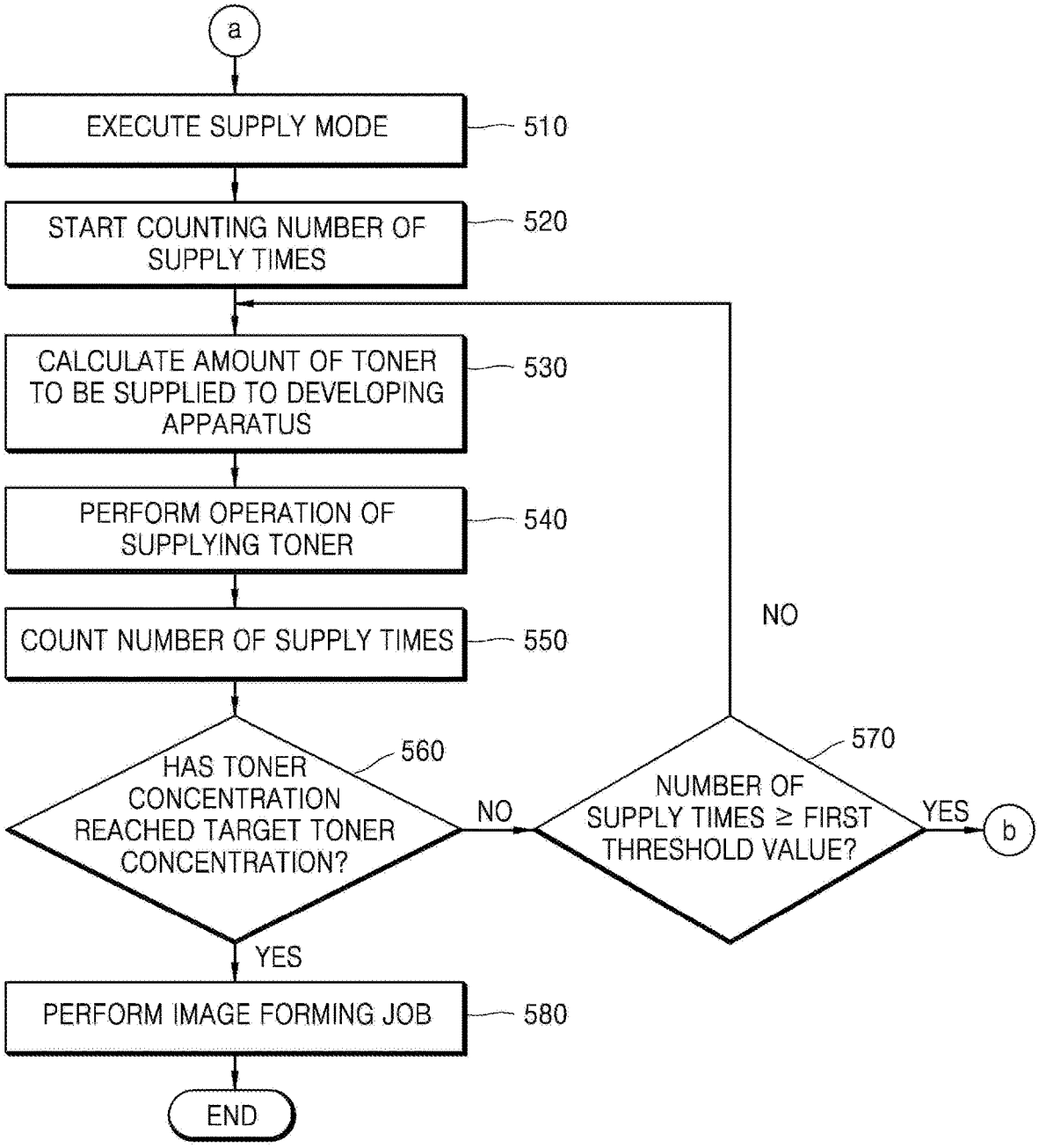
FIG. 5 is a diagram for describing a process of monitoring whether a toner concentration reaches a target toner concentration as a supply mode is executed in an image forming apparatus, according to an example.

FIG. 5 is a diagram for describing a process of monitoring whether a toner concentration reaches a target toner concentration as a supply mode is executed in an image forming apparatus, according to an example.

Referring to FIG. 5, the image forming apparatus 10 may execute a supply mode of supplying toner to the developing apparatus 1110 in operation 510.

In operation 520, the image forming apparatus 10 may start counting the number of supply times as the supply mode is executed. For example, the image forming apparatus 10 may reset the number of supply times when the supply mode is first executed.

In operation 530, the image forming apparatus 10 may calculate the amount of toner to be supplied to the developing apparatus 1110. For example, the image forming apparatus 10 may calculate the amount of toner to be supplied to the developing apparatus 1110 based on a difference between the toner concentration obtained by the toner concentration sensor and the target toner concentration.

In operation 540, the image forming apparatus 10 may perform an operation of supplying toner to the developing apparatus 1110 one time.

In operation 550, the image forming apparatus 10 may count the number of supply times.

In operation 560, the image forming apparatus 10 may monitor whether the toner concentration reaches the target toner concentration.

When it is determined that the toner concentration has not reached the target toner concentration, the image forming apparatus 10 may determine whether the number of supply times is equal to or greater than the first threshold value, in accordance with operation 570. The first threshold value may be the number of supply times corresponding to a point in time at which the driving speed of the developing apparatus 1110 is increased. When the number of supply times is less than the first threshold value, the image forming apparatus 10 may perform an operation in accordance with operation 530. Here, the image forming apparatus 10 may execute the supply mode while maintaining the existing driving speed of the developing apparatus 1110. Otherwise, when the number of supply times is equal to or greater than the first threshold value, the image forming apparatus 10 may perform operation ⓑ to change the driving speed of the developing apparatus 1110 to a driving speed of the high-speed drive mode. An example of operation ⓑ will be described in FIG. 6.

Otherwise, when it is determined that the toner concentration has reached the target toner concentration, the image forming apparatus 10 may perform the image forming job in accordance with operation 580.

Figure 6:
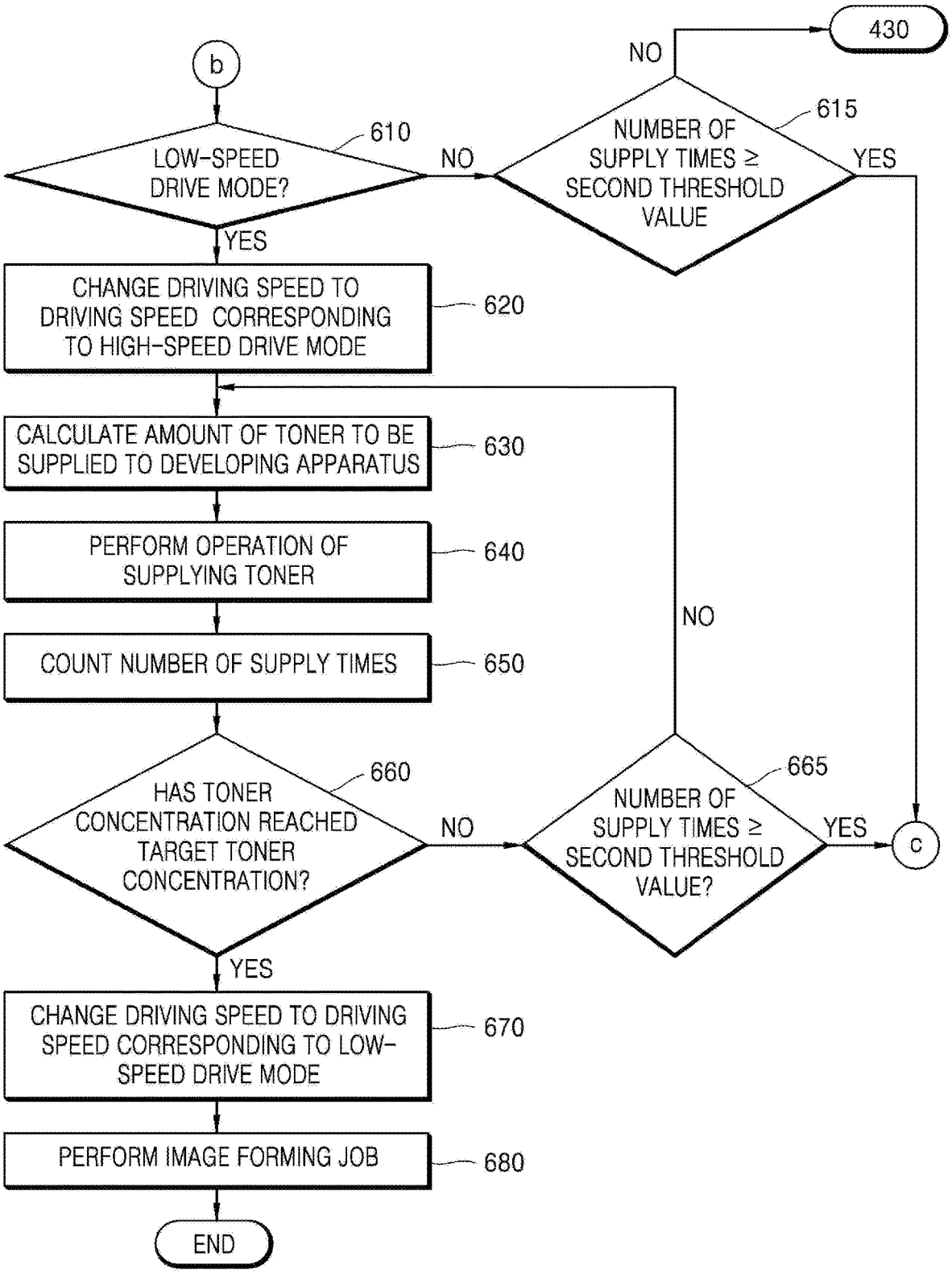
FIG. 6 is a diagram for describing a process of increasing a driving speed of a developing apparatus and monitoring whether a toner concentration reaches a target toner concentration as a supply mode of a low-speed drive mode is executed in the developing apparatus, according to an example.

FIG. 6 is a diagram for describing a process of increasing a driving speed of a developing apparatus and monitoring whether a toner concentration reaches a target toner concentration as a supply mode of a low-speed drive mode is executed in the developing apparatus, according to an example.

Referring to FIG. 6, the image forming apparatus 10 may confirm that the driving speed of the developing apparatus 1110 is a driving speed corresponding to a low-speed drive mode in operation 610.

When the driving speed of the developing apparatus 1110 is not the driving speed corresponding to the low-speed drive mode, the image forming apparatus 10 may determine whether the number of supply times is equal to or greater than a second threshold value, in accordance with operation 615. Here, the second threshold value may indicate the maximum number of supply times, which is a reference for determining an error of the supply mode. When the number of supply times is equal to or greater than the second threshold value, the image forming apparatus 10 may perform operation ⓒ. Otherwise, when the number of supply times is less than the second threshold value, the image forming apparatus 10 may perform operation 430 as described in FIG. 4.

Otherwise, when the driving speed of the developing apparatus 1110 is the driving speed corresponding to the low-speed drive mode, the image forming apparatus 10 may change the driving speed corresponding to the low-speed drive mode to a driving speed corresponding to a high-speed drive mode in accordance with operation 620.

In operation 630, the image forming apparatus 10 may calculate the amount of toner to be supplied to the developing apparatus 1110. For example, the image forming apparatus 10 may calculate the amount of toner to be supplied to the developing apparatus 1110 based on a difference between a toner concentration obtained by the toner concentration sensor and the target toner concentration.

In operation 640, the image forming apparatus 10 may perform an operation of supplying toner to the developing apparatus 1110 one time.

In operation 650, the image forming apparatus 10 may count the number of supply times by increasing the accumulated number of supply times by one.

In operation 660, the image forming apparatus 10 may monitor whether the toner concentration reaches the target toner concentration.

When it is determined that the toner concentration has not reached the target toner concentration, the image forming apparatus 10 may determine whether the number of supply times is equal to or greater than the second threshold value, in accordance with operation 665. When the number of supply times is less than the second threshold value, the image forming apparatus 10 may perform the operation in accordance with operation 630. Here, the image forming apparatus 10 may execute a supply mode while maintaining a driving speed corresponding to the high-speed drive mode of the developing apparatus 1110. Otherwise, when the number of supply times is equal to or greater than the second threshold value, the image forming apparatus 10 may perform operation ⓒ.

Otherwise, when it is determined that the toner concentration has reached the target toner concentration, the image forming apparatus 10 may change the driving speed corresponding to the high-speed drive mode to the driving speed corresponding to the low-speed drive mode in accordance with operation 670.

According to operation 680, the image forming apparatus 10 may perform an image forming job according to the driving speed corresponding to the low-speed drive mode.

Figure 7:
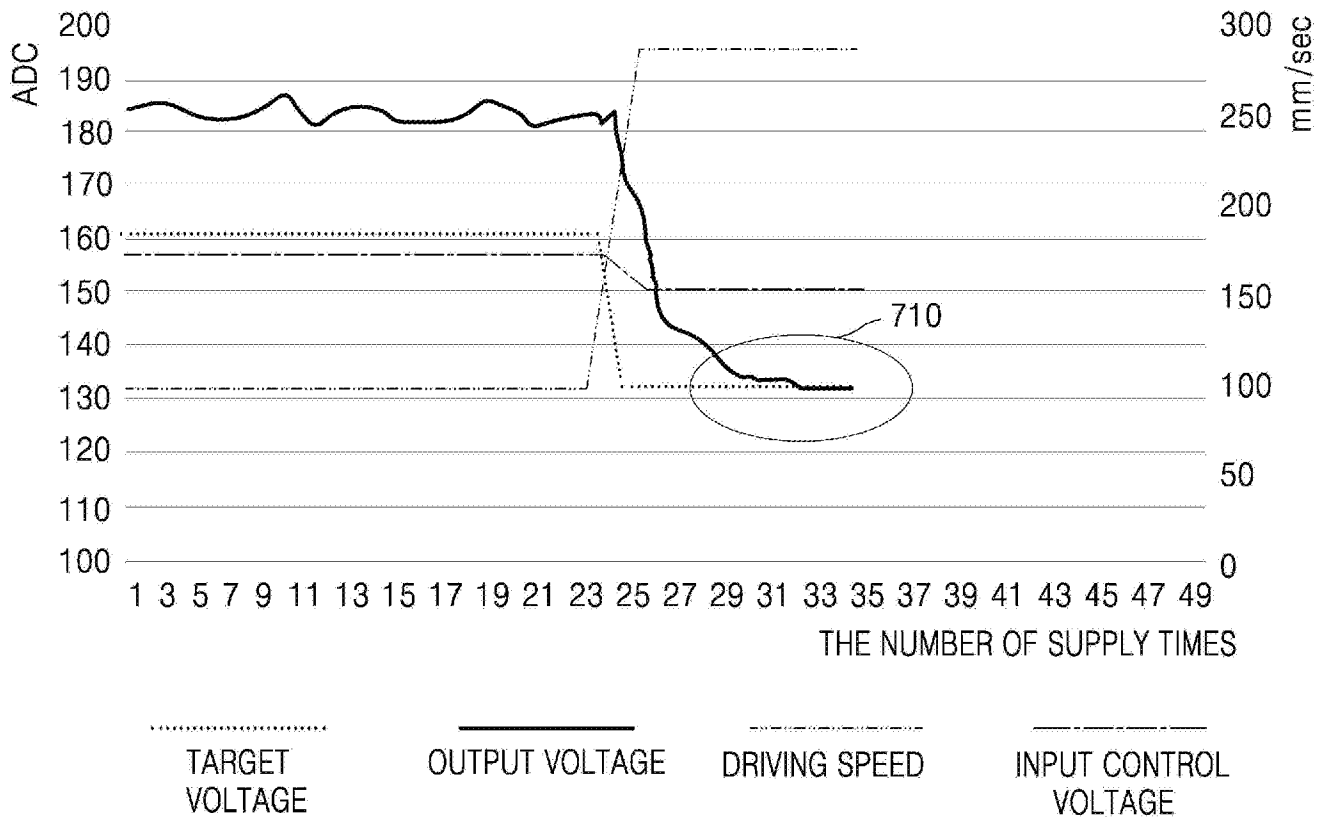
FIG. 7 is a diagram for describing an output voltage of a toner concentration sensor and a target toner concentration voltage when a developing apparatus is changed from a low-speed drive mode to a high-speed drive mode, according to an example.

FIG. 7 is a diagram for describing an output voltage of a toner concentration sensor and a target toner concentration voltage when a developing apparatus is changed from a low-speed drive mode to a high-speed drive mode, according to an example.

Referring to FIG. 7, the developing apparatus 1110 may be operated in a low-speed drive mode, such as at a driving speed of 90 mm/sec. The toner concentration sensor may sense a carrier in a certain region of the developing apparatus 1110 and may obtain an output voltage proportional to the amount of carrier. Therefore, the higher the output voltage, the lower a toner concentration that represents the ratio of toner to a developer. Conversely, the lower the output voltage, the higher the toner concentration that represents the ratio of the toner to the developer.

Referring to FIG. 7, the output voltage of the toner concentration sensor of the developing apparatus 1110 in the low-speed drive mode is higher than a target voltage. Therefore, since the toner concentration of the developing apparatus 1110 is less than the target toner concentration, a supply mode for supplying toner to the developing apparatus 1110 may be executed.

The image forming apparatus 10 may confirm whether the supply mode is normally executed while maintaining a drive speed corresponding to the low-speed drive mode for a certain time. Here, the certain time may be expressed by the number of supply times. When the output voltage does not reach the target voltage even if the certain time has elapsed, there may be a state where the toner is not evenly distributed in the developing apparatus 1110, a state where the toner concentration sensor malfunctions, or a state where the toner is consumed and an amount of toner in a toner cartridge is insufficient. Therefore, in order to quickly determine a state of the supply mode, a first threshold value representing the certain time (i.e., number of supply times) may be determined. For example, the first threshold value may be 25. The image forming apparatus 10 may execute the supply mode in the low-speed drive mode until the number of supply times reaches 25 and monitor whether the toner concentration has reached a target toner concentration.

When the toner concentration does not reach the target toner concentration before or when the number of supply times reaches 25, the image forming apparatus 10 may increase a driving speed corresponding to the low-speed drive mode to a driving speed corresponding to the high-speed drive mode. For example, the image forming apparatus 10 may increase the driving speed from 90 mm/sec to 280 mm/sec.

The toner concentration of the developing apparatus 1110 may need to be physically maintained in a case where the developing apparatus 1110 is in the low-speed drive mode or in the high-speed drive mode. Since a driving speed of the developing apparatus 1110 in the low-speed drive mode is less than a driving speed of the developing apparatus 1110 in the high-speed drive mode, the volume and the pressure of a region that may be sensed by the toner concentration sensor are different. Therefore, in order to physically maintain the toner concentration of the developing apparatus 1110, the image forming apparatus 10 may reduce the target voltage and a control voltage input to the toner concentration sensor as the driving speed of the low-speed drive mode is increased to the driving speed of the high-speed drive mode. Referring to FIG. 7, the target voltage and the input control voltage with respect to 25 supply times is reduced to be less than the target voltage and the input control voltage with respect to less than 25 supply times.

The image forming apparatus 10 may measure the toner concentration while monitoring whether the toner concentration has reached the target toner concentration until the toner concentration reaches a second threshold value indicating the maximum number of supply times. For example, the second threshold value may be 50.

Referring to region 710 of FIG. 7, when the number of times of supply reaches 34, the output voltage may reach the target voltage. The image forming apparatus 10 may determine that the toner concentration has reached the target toner concentration and may change the driving speed of the high-speed drive mode to the driving speed of the low-speed drive mode.

Figure 8:
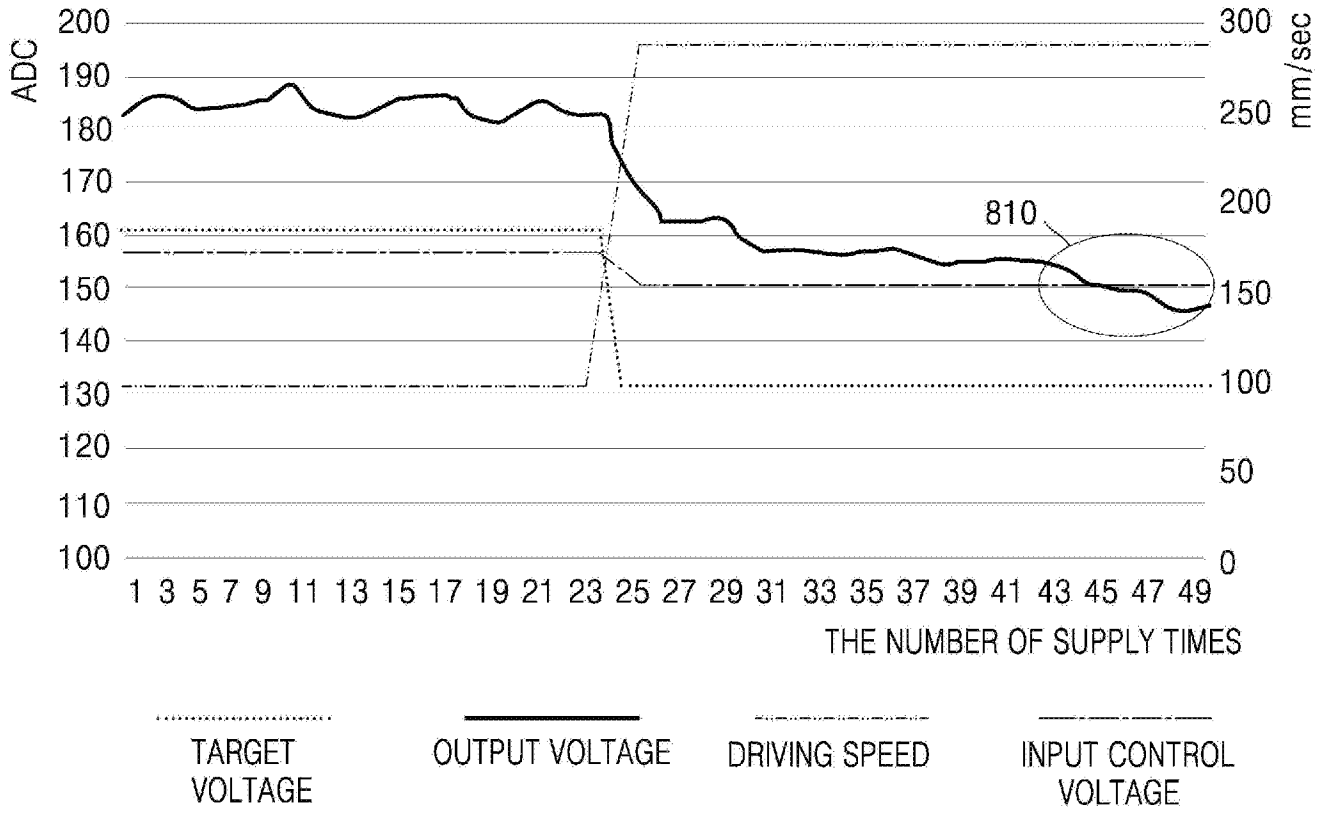
FIG. 8 is a diagram for describing an output voltage of a toner concentration sensor and a target toner concentration voltage when a developing apparatus is changed from a low-speed drive mode to a high-speed drive mode, according to an example.

FIG. 8 is a diagram for describing an output voltage of a toner concentration sensor and a target toner concentration voltage when a developing apparatus is changed from a low-speed drive mode to a high-speed drive mode, according to an example.

Referring to FIG. 8, the developing apparatus 1110 may be operated in a low-speed drive mode, such as at a driving speed of 90 mm/sec. The output voltage of the toner concentration sensor of the developing apparatus 1110 in the low-speed drive mode is higher than a target voltage. Therefore, since the toner concentration of the developing apparatus 1110 is lower than a target toner concentration, a supply mode for supplying toner to the developing apparatus 1110 may be executed until the number of supply times reaches a first threshold value. The first threshold value may be set to 25 supply times.

The image forming apparatus 10 may execute the supply mode in the low-speed drive mode until the number of supply times reaches 25 and monitor whether the toner concentration has reached the target toner concentration.

When the toner concentration has not reached the target toner concentration when the number of supply times reaches 25, the image forming apparatus 10 may increase the driving speed corresponding to the low-speed drive mode to the driving speed corresponding to the high-speed drive mode. For example, the image forming apparatus 10 may increase the driving speed from 90 mm/sec to 280 mm/sec.

Referring to FIG. 8, in order to physically maintain the toner concentration of the developing apparatus 1110, the image forming apparatus 10 may reduce the target voltage and the control voltage input to the toner concentration sensor as the driving speed of the low-speed drive mode is increased to the driving speed of the high-speed drive mode.

The image forming apparatus 10 may measure the toner concentration while monitoring whether the toner concentration has reached the target toner concentration until a number of supply times reaches a second threshold value indicating the maximum number of supply times. For example, the second threshold value may be 50.

Referring to region 810 of FIG. 8, the output voltage may not reach the target voltage when the number of supply times reaches 50. In that case, the image forming apparatus 10 may determine that an error has occurred in the supply mode.

Figure 9:
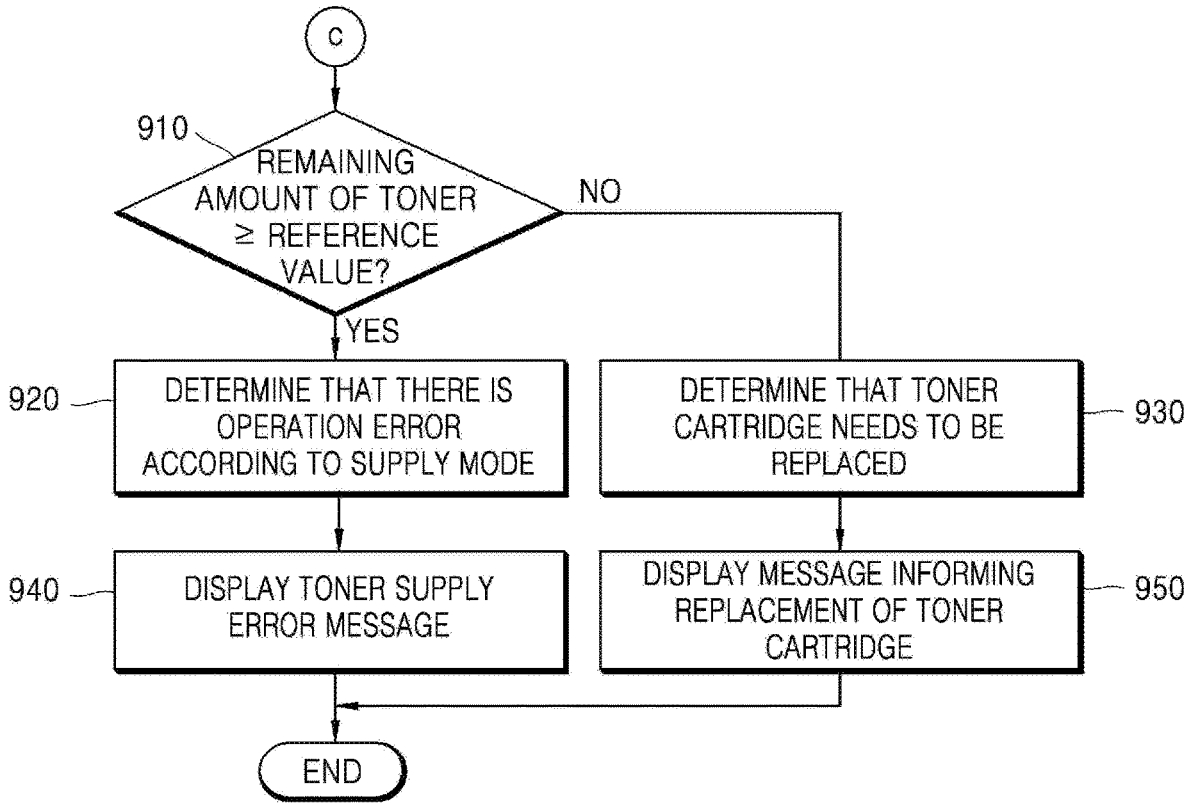
FIG. 9 is a diagram for describing a method of determining an operating state of an image forming apparatus based on a remaining amount of toner when it is determined that a toner concentration has not reached a target toner concentration, according to an example.

FIG. 9 is a diagram for describing a method of determining an operating state of an image forming apparatus based on a remaining amount of toner when it is determined that a toner concentration has not reached a target toner concentration, according to an example.

Referring to FIG. 9, the image forming apparatus 10 may determine whether the remaining amount of toner in a toner cartridge is equal to or greater than a reference value in operation 910. For example, the reference value may be the remaining amount of toner, which is a reference value that indicates the need to replace the toner cartridge.

When the remaining amount of toner is equal to or greater than the reference value, the image forming apparatus 10 may determine that there is an operation error according to the supply mode, according to operation 920. For example, the image forming apparatus 10 may determine that a certain component in the developing apparatus 1110 is defective. In operation 940, the image forming apparatus 10 may display a toner supply error message for the supply mode.

Otherwise, when the remaining amount of the toner is less than the reference value, the image forming apparatus 10 may determine that the toner cartridge needs to be replaced according to operation 930. In operation 950, the image forming apparatus 10 may display a message informing of the need to replace the toner cartridge.

Figure 10:
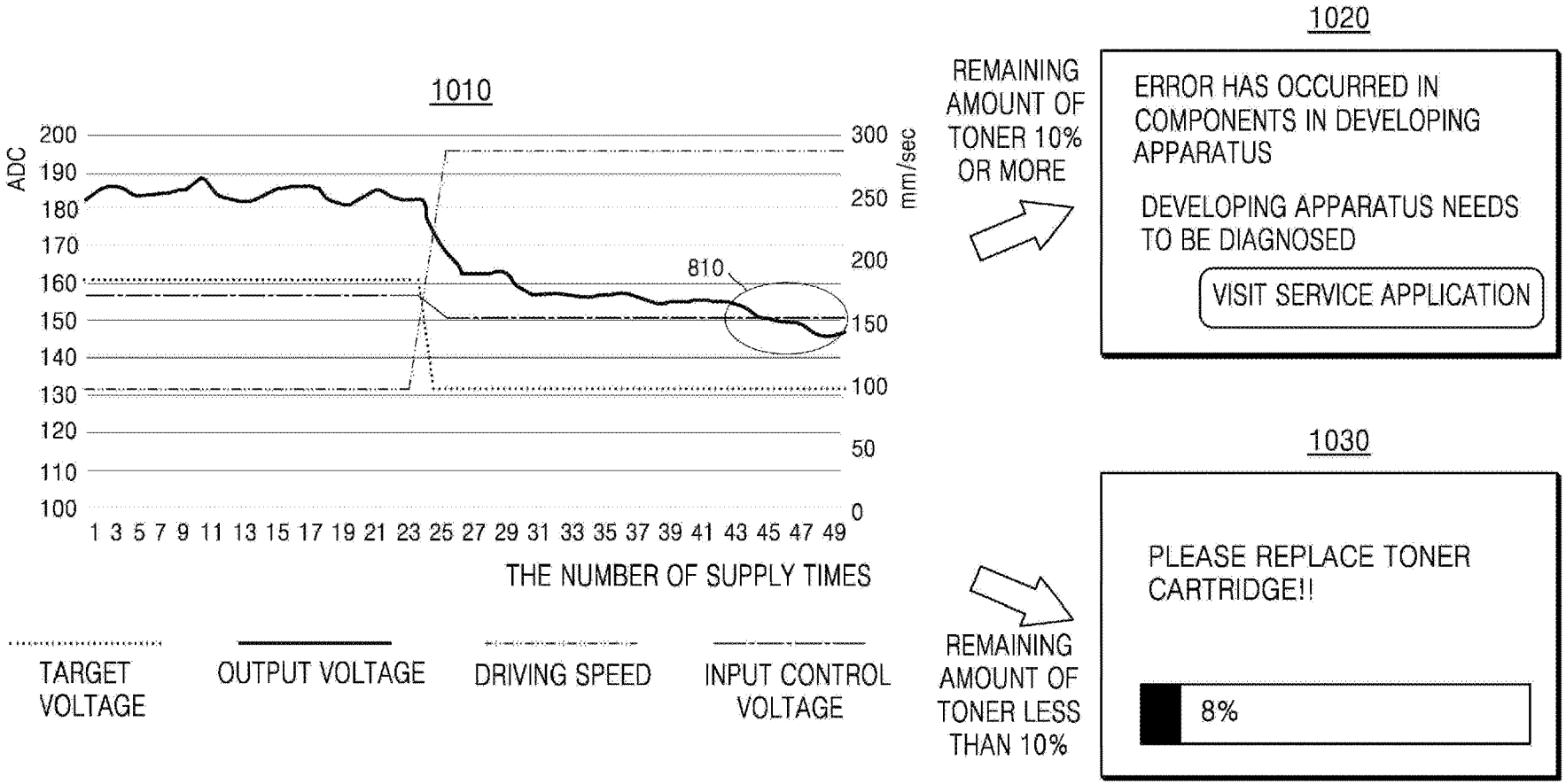
FIG. 10 is a diagram for describing a message according to an operating state of an image forming apparatus displayed on a user interface apparatus of the image forming apparatus, according to an example.

FIG. 10 is a diagram for describing a message according to an operating state of an image forming apparatus displayed on a user interface apparatus of the image forming apparatus, according to an example.

Referring to FIG. 10, a graph shown in an image 1010 is the same as the graph shown in FIG. 8. In FIG. 10, the same reference numerals as in FIG. 8 denote the same elements, and therefore, repeated descriptions thereof will not be given herein.

Referring to the image 1010 of FIG. 10, the output voltage may not reach the target voltage when the number of supply times reaches 50. In that case, the image forming apparatus 10 may determine that an error has occurred in the supply mode.

Referring to an image 1020 in FIG. 10, when the remaining amount of toner is 10% or more of the amount of toner that may be contained in a toner cartridge, the image forming apparatus 10 may determine that a certain component in the developing apparatus 1110 is defective. The image forming apparatus 10 may display a toner supply error message such as "An error has occurred in components in the developing apparatus 1110. The developing apparatus 1110 needs to be diagnosed." In addition, the image forming apparatus 10 may display an icon such as a "visit service application" icon in which a user may immediately apply for a visit service.

Referring to an image 1030 in FIG. 10, when the remaining amount of toner is less than 10% of the amount of toner that may be contained in the toner cartridge, the image forming apparatus 10 may determine that the toner cartridge needs to be replaced. The image forming apparatus 10 may display a message informing of the need to replace the toner cartridge such as "Please replace the toner cartridge."

Figure 11:
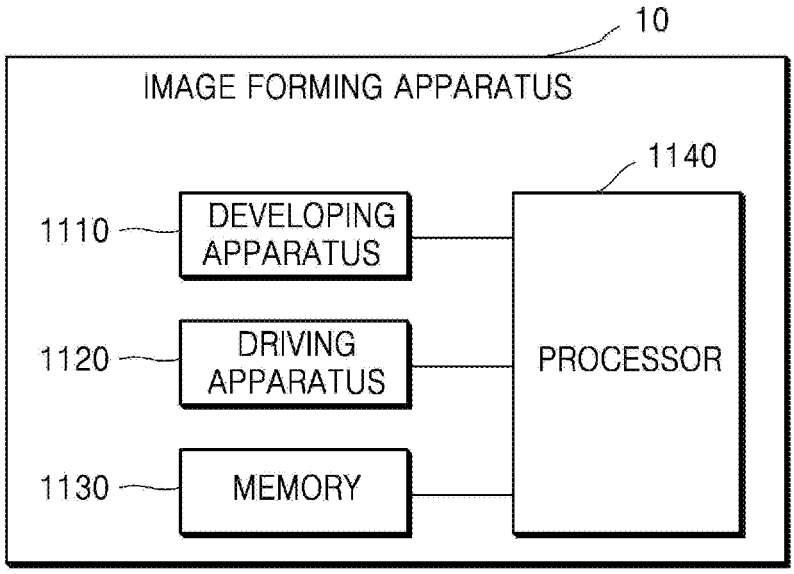
FIG. 11 is a block diagram of an image forming apparatus, according to an example.

FIG. 11 is a block diagram of an image forming apparatus, according to an example.

Referring to FIG. 11, the image forming apparatus 10 may include the developing apparatus 1110, a driving apparatus 1120, a memory 1130, and a processor 1140. However, not all elements shown in the drawings are necessary elements. The image forming apparatus 10 may be embodied with more or fewer elements than the elements shown in the drawings. Hereinafter, the elements will be described.

The developing apparatus 1110 may rotatably support a developing roller for supplying toner to a photoconductor. The developing apparatus 1110 may include a toner concentration sensor for measuring a toner concentration of developer composed of toner and a carrier. The driving apparatus 1120 may drive the developing apparatus 1110. The processor 1140 may control the driving apparatus 1120 such that the developing apparatus 1110 may be driven by the driving apparatus 1120. The processor 1140 may control an operation of the driving apparatus 1120 according to a driving speed of the developing apparatus 1110.

The memory 1130 may store programs, data, or files associated with the image forming apparatus 10. For example, the processor 1140 may execute a program stored in the memory 1130, read data or a file stored in the memory 1130, or store a new file in the memory 1130. The memory 1130 may store program commands, data files, data structures, or a combination thereof. The memory 1130 may store instructions executable by the processor 1140.

The processor 1140 may control an operation of the image forming apparatus 10 and may include at least one processor, such as a central processing unit (CPU). The processor 1140 may include at least one specialized processor corresponding to each function or may be a single integrated processor.

As a supply mode for supplying toner to the developing apparatus 1110 in the image forming apparatus 10 is executed, the processor 1140 may measure a concentration of the toner supplied into the developing apparatus 1110 through a toner concentration sensor installed in the developing apparatus 1110.

For example, the processor 1140 may obtain the toner concentration of the developing apparatus 1110 based on a voltage value output by the toner concentration sensor. The processor 1140 may compare the toner concentration of the developing apparatus 1110 with a target toner concentration and may execute the supply mode for supplying toner to the developing apparatus 1110 when a difference between the toner concentration and the target toner concentration deviates from a certain range.

For example, when the supply mode is executed in a preset low-speed drive mode of the developing apparatus 1110, the processor 1140 may maintain the driving speed corresponding to the low-speed drive mode until the number of supply times reaches a first threshold value. Here, the number of supply times may be determined according to the supply mode. The first threshold value may be the number of supply times corresponding to a point in time at which the driving speed of the developing apparatus 1110 is increased. The processor 1140 may increase the number of supply times by one and measure the toner concentration.

For example, the processor 1140 may calculate the amount of toner to be supplied based on the toner concentration in the developing apparatus 1110 and a target toner concentration. The processor 1140 may determine a first threshold value based on the amount of toner to be supplied and the amount of toner supplied per the number of supply times of the toner.

When it is determined that the toner concentration has not reached the target toner concentration, the processor 1140 may increase the driving speed of the developing apparatus 1110.

For example, when it is determined that the toner concentration has not reached the target toner concentration when the number of supply times reaches the first threshold value, the processor 1140 may increase the driving speed of the developing apparatus 1110 to a driving speed corresponding to a preset high-speed drive mode.

For example, as the driving speed of the developing apparatus 1110 is increased to the driving speed corresponding to the preset high-speed drive mode, the processor 1140 may maintain the target toner concentration by reducing the target voltage corresponding to the target toner concentration and the control voltage input to the toner concentration sensor.

As the supply mode is executed in a state where the driving speed of the developing apparatus 1110 is increased, the processor 1140 may measure the concentration of the toner in the developing apparatus 1110 through the toner concentration sensor.

For example, the processor 1140 may monitor whether the toner concentration has reached the target toner concentration when the number of supply times reaches a second threshold value indicating the maximum number of supply times. In an example, the maximum number of supply times is a reference for determining an error of the supply mode. The processor 1140 may increase the number of supply times by one and measure the toner concentration.

When it is determined that the toner concentration has not reached the target toner concentration in a state where the driving speed of the developing apparatus 1110 is increased, the processor 1140 may determine an operating state of the image forming apparatus 10 based on a remaining amount of toner. Here, the remaining amount of the toner may refer to an amount of toner in a toner container for containing toner in a cartridge. The toner container may supply toner to the developing apparatus 1110.

For example, when it is determined that the toner concentration has not reached the target toner concentration when the number of supply times reaches the second threshold value and the remaining amount of toner is greater than a reference value, the processor 1140 may determine that there is an operation error according to the supply mode. The processor 1250 may display a toner supply error message for the supply mode through a user interface device (not shown).

As another example, when it is determined that the toner concentration has not reached the target toner concentration when the number of supply times reaches the second threshold value and the remaining amount of toner is less than a reference value, the processor 1140 may determine that the toner cartridge needs to be replaced. The processor 1140 may display a message informing of the need to replace the cartridge through a user interface device (not shown).

Meanwhile, when it is determined that the toner concentration has reached the target toner concentration as the supply mode is executed in a state where the driving speed of the developing apparatus 1110 is increased, the processor 1140 may change the driving speed in the increased state to a driving speed in the existing state. The processor 1140 may perform a certain image forming job at the driving speed in the existing state. For example, the developing apparatus 1110 may be changed from the supply mode of the low-speed drive mode to the supply mode of the high-speed drive mode. When the toner concentration reaches the target toner concentration in the supply mode of the high-speed drive mode, the processor 1140 may change the high-speed drive mode to the low-speed drive mode and perform a certain image forming job at the driving speed corresponding to the low-speed drive mode.

The above-described method of operating the image forming apparatus 10 may be implemented as a non-transitory computer-readable recording medium storing instructions or data executable by a computer or a processor. The examples may be written as computer programs and may be implemented in general-use digital computers that execute programs using the computer-readable recording medium. The computer-readable recording medium may include read only memory (ROM), random access memory (RAM), flash memory, CD-ROMs, CD-Rs, CD+Rs, CD-DVD-Rs, DVD-Rs, DVD-RWs, DVD+RWs, DVD-RAMs, BD-ROMs, BD-Rs, BD-R LTHs, BD-REs, magnetic tapes, floppy disks, magneto-optical data storage devices, optical data storage devices, hard disks, or solid-state disks (SSD), and may be any device capable of storing instructions or software, associated data, data files, and data structures, and providing the instructions or software, associated data, data files, and data structures to a processor or a computer such that the processor or computer may execute the instructions.

Although examples have been described with reference to the accompanying drawings, those of ordinary skill in the art will understand that various changes and modifications may be made therein. For example, the relevant results may be achieved even when the described technologies are performed in a different order than the described methods, and/or even when the described elements such as systems, structures, devices, and circuits are coupled or combined in a different form than the described methods or are replaced or substituted by other elements or equivalents.

It should be understood that examples described herein should be considered in a descriptive sense only and not for purposes of limitation. Descriptions of features or aspects within each embodiment should typically be considered as available for other similar features or aspects in other embodiments. While one or more examples have been described with reference to the figures, it will be understood by those of ordinary skill in the art that various changes in form and details may be made therein without departing from the spirit and scope as defined by the following claims.

What is claimed is:

1. A method of operating an image forming apparatus, the method comprising:

measuring a toner concentration supplied to a developing apparatus through a toner concentration sensor provided in the developing apparatus as a supply mode for supplying toner to the developing apparatus in the image forming apparatus is executed;

increasing a driving speed of the developing apparatus based on determining that the toner concentration has not reached a target toner concentration;

measuring the toner concentration in the developing apparatus through the toner concentration sensor as the supply mode is executed in a state where the driving speed of the developing apparatus is increased; and determining an operating state of the image forming apparatus based on a remaining amount of toner based on determining that the toner concentration has not reached the target toner concentration in the state where the driving speed of the developing apparatus is increased, wherein the measuring of the toner concentration comprises, based on the supply mode being executed in a preset low-speed drive mode of the developing apparatus, maintaining the driving speed corresponding to the low-speed drive mode until a number of supply times counted according to the supply mode reaches a first threshold value corresponding to a point in time at which the driving speed of the developing apparatus is increased, and wherein the determining of the operating state of the image forming apparatus based on the remaining amount of toner comprises determining that there is a defective component based on the remaining amount of the toner being greater than or equal to a reference value or that a toner cartridge needs to be replaced based on the remaining amount of the toner being less than the reference value.

2. The method of claim 1, wherein the increasing of the driving speed of the developing apparatus comprises:

based on determining that the toner concentration has not reached the target toner concentration based on the number of supply times reaching the first threshold value, increasing the driving speed of the developing apparatus to a driving speed corresponding to a preset high-speed drive mode.

3. The method of claim 1, wherein the increasing of the driving speed of the developing apparatus comprises:

as the driving speed of the developing apparatus is increased to a driving speed corresponding to a preset high-speed drive mode, maintaining the target toner concentration by reducing a target voltage corresponding to the target toner concentration and a control voltage input to the toner concentration sensor.

4. The method of claim 1, further comprising:

based on determining that the toner concentration has reached the target toner concentration as the supply mode is executed in a state where the driving speed of the developing apparatus is increased, changing the driving speed in the increased state to a driving speed in an existing state and performing a certain image forming job at the driving speed in the existing state.

5. The method of claim 1, wherein the increasing of the driving speed of the developing apparatus comprises:

calculating the amount of toner to be supplied based on the toner concentration in the developing apparatus and the target toner concentration; and determining the first threshold value based on the amount of toner to be supplied and the amount of toner supplied per the number of supply times of the toner.

6. The method of claim 1, wherein the measuring of the toner concentration as the supply mode is executed in the state where the driving speed of the developing apparatus is increased comprises:

measuring the toner concentration in the developing apparatus while monitoring whether the toner concentration reaches the target toner concentration based on a number of supply times counted according to the supply mode reaching a second threshold value indicating a maximum number of supply times as a reference for determining an error of the supply mode.

7. The method of claim 6, wherein the determining of the operating state of the image forming apparatus based on the remaining amount of the toner comprises:

determining that there is the defective component based on determining that the toner concentration has not reached the target toner concentration based on the number of supply times reaching the second threshold value and the remaining amount of the toner is greater than or equal to the reference value; and displaying a toner supply error message for the supply mode.

8. The method of claim 6, wherein the determining of the operating state of the image forming apparatus based on the remaining amount of the toner comprises:

determining that the toner cartridge needs to be replaced based on determining that the toner concentration has not reached the target toner concentration based on the number of supply times reaching the second threshold value and the remaining amount of toner is less than the reference value; and displaying a message informing of the need to replace the toner cartridge.

9. A non-transitory computer-readable storage medium storing instructions executable by a processor, the non-transitory computer-readable storage medium comprising:

instructions to measure a toner concentration supplied to a developing apparatus through a toner concentration sensor provided in the developing apparatus as a supply mode for supplying toner to the developing apparatus in an image forming apparatus is executed;

instructions to increase a driving speed of the developing apparatus based on determining that the toner concentration has not reached a target toner concentration;

instructions to measure the toner concentration in the developing apparatus through the toner concentration sensor as the supply mode is executed in a state where the driving speed of the developing apparatus is increased;

instructions to determine an operating state of the image forming apparatus based on a remaining amount of toner based on determining that the toner concentration has not reached the target toner concentration; and instructions to, based on the supply mode being executed in a preset low-speed drive mode of the developing apparatus, control a driving apparatus to maintain a driving speed corresponding to the low-speed drive mode until a number of supply times counted according to the supply mode reaches a first threshold value corresponding to a point in time at which the driving speed of the developing apparatus is increased, wherein the instructions to determine the operating state of the image forming apparatus based on the remaining amount of toner comprise instructions to determine that there is a defective component based on the remaining amount of the toner being greater than or equal to a reference value or that a toner cartridge needs to be replaced based on the remaining amount of the toner being less than the reference value.

10. The non-transitory computer-readable storage medium of claim 9, further comprising instructions to, based on determining that the toner concentration has not reached the target toner concentration based on the number of supply times reaching the first threshold value, increase the driving speed of the developing apparatus to a driving speed corresponding to a preset high-speed drive mode.

11. The non-transitory computer-readable storage medium of claim 9, further comprising instructions to, as the driving speed of the developing apparatus is increased to a driving speed corresponding to a preset high-speed drive mode, maintain the target toner concentration by reducing a target voltage corresponding to the target toner concentration and a control voltage input to the toner concentration sensor.

12. The non-transitory computer-readable storage medium of claim 9, further comprising instructions to, based on determining that the toner concentration has reached the target toner concentration as the supply mode is executed in a state where the driving speed of the developing apparatus is increased, change the driving speed in the increased state to a driving speed in an existing state and performing a certain image forming job at the driving speed in the existing state.

13. The non-transitory computer-readable storage medium of claim 9, further comprising:

instructions to calculate the amount of toner to be supplied based on the toner concentration in the developing apparatus and the target toner concentration; and instructions to determine the first threshold value based on the amount of toner to be supplied and the amount of toner supplied per the number of supply times of the toner.

14. The non-transitory computer-readable storage medium of claim 9, further comprising instructions to measure the toner concentration in the developing apparatus while monitoring whether the toner concentration reaches the target toner concentration based on the number of supply times counted according to the supply mode reaching a second threshold value indicating a maximum number of supply times as a reference for determining an error of the supply mode.

15. The non-transitory computer-readable storage medium of claim 14, further comprising:

instructions to determine that there is the defective component based on determining that the toner concentration has not reached the target toner concentration based on the number of supply times reaching the second threshold value and the remaining amount of the toner is greater than or equal to the reference value; and instructions to display a toner supply error message for the supply mode.

16. The non-transitory computer-readable storage medium of claim 14, further comprising:

instructions to determine that the toner cartridge needs to be replaced based on determining that the toner concentration has not reached the target toner concentration based on the number of supply times reaching the second threshold value and the remaining amount of toner is less than the reference value; and instructions to display a message informing of the need to replace the toner cartridge.

17. An image forming apparatus comprising:

a developing apparatus to rotatably support a developing roller for supplying toner to a photoconductor, and comprising a toner concentration sensor for measuring a toner concentration of a developer composed of the toner and a carrier;

a driving apparatus to drive the developing apparatus;

a processor; and a memory to store instructions executable by the memory, wherein the processor executes the instructions to:

measure a toner concentration supplied to the developing apparatus through the toner concentration sensor as a supply mode for supplying toner to the developing apparatus is executed;

increase a driving speed of the developing apparatus based on determining that the toner concentration has not reached a target toner concentration;

measure the toner concentration in the developing apparatus through the toner concentration sensor as the supply mode is executed in a state where the driving speed of the developing apparatus is increased;

determine an operating state of the image forming apparatus based on a remaining amount of toner based on determining that the toner concentration has not reached the target toner concentration; and based on the supply mode being executed in a preset low-speed drive mode of the developing apparatus, control the driving apparatus to maintain a driving speed corresponding to the low-speed drive mode until a number of supply times counted according to the supply mode reaches a first threshold value corresponding to a point in time at which the driving speed of the developing apparatus is increased, wherein the processor executes the instructions to determine the operating state of the image forming apparatus based on the remaining amount of toner by executing the instructions to determine that there is a defective component based on the remaining amount of the toner being greater than or equal to a reference value or that a toner cartridge needs to be replaced based on the remaining amount of the toner being less than the reference value.

18. The image forming apparatus of claim 17, wherein the processor executes the instructions to:

based on determining that the toner concentration has not reached the target toner concentration based on the number of supply times reaching the first threshold value, increase the driving speed of the developing apparatus to a driving speed corresponding to a preset high-speed drive mode.

19. The image forming apparatus of claim 17, wherein the processor executes the instructions to:

measure the toner concentration in the developing apparatus while monitoring whether the toner concentration reaches the target toner concentration based on the number of supply times counted according to the supply mode reaching a second threshold value indicating a maximum number of supply times as a reference for determining an error of the supply mode.

20. The image forming apparatus of claim 17, wherein the processor executes the instructions to:

as the driving speed of the developing apparatus is increased to a driving speed corresponding to a preset high-speed drive mode, maintain the target toner concentration by reducing a target voltage corresponding to the target toner concentration and a control voltage input to the toner concentration sensor.

* * * * *